US010876437B2

(12) United States Patent
Schott et al.

(10) Patent No.: US 10,876,437 B2
(45) Date of Patent: Dec. 29, 2020

(54) VARIABLE VALVE TRAIN OF AN INTERNAL COMBUSTION ENGINE

(71) Applicant: Schaeffler Technologies AG & Co. KG, Herzogenaurach (DE)

(72) Inventors: Dimitri Schott, Wachenroth (DE); Harald Elendt, Altendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 61 days.

(21) Appl. No.: 16/216,132

(22) Filed: Dec. 11, 2018

(65) Prior Publication Data

US 2019/0178116 A1 Jun. 13, 2019

(30) Foreign Application Priority Data

Dec. 11, 2017 (DE) ..... 10 2017 129 419

(51) Int. Cl.
*F01L 13/00* (2006.01)
*F01L 1/053* (2006.01)
(Continued)

(52) U.S. Cl.
CPC ..... *F01L 13/0036* (2013.01); *F01L 1/053* (2013.01); *F01L 1/185* (2013.01); *F01L 13/0005* (2013.01);
(Continued)

(58) Field of Classification Search
CPC . F01L 1/053; F01L 1/185; F01L 1/181; F01L 1/18; F01L 13/0005; F01L 13/00;
(Continued)

(56) References Cited

U.S. PATENT DOCUMENTS 5,544,626 A 8/1996 Diggs et al.
2019/0376420 A1* 12/2019 Elendt ..... F01L 1/185
2020/0032718 A1* 1/2020 Bilan ..... F02D 13/0207

FOREIGN PATENT DOCUMENTS

DE 10212327 3/2003
DE 10330510 1/2005
(Continued)

*Primary Examiner* — Devon C Kramer
*Assistant Examiner* — Kelsey L Stanek
(74) *Attorney, Agent, or Firm* — Volpe Koenig

(57) ABSTRACT

A variable valve train with at least two functionally identical gas-exchange valves per cylinder, having primary cam and a secondary cam generated valve strokes that are transmitted by a switchable cam follower selectively to the gas-exchange valves. The respective cam follower has a primary lever in tapping contact with the primary cam and in switching contact with the gas-exchange valve and a secondary lever that is in tapping contact with the secondary cam and is coupleable with the primary lever by a control pin. The respective control pins are connected by connecting elements to respective first and second elongated switching elements, which are arranged above the cam followers parallel to the camshaft and are displaceable longitudinally by a linear actuator from a home into a switched position. The control pins of the cam follower of functionally identical gas-exchange valves are in switching connection with a respective one of the first and second elongated switching elements for common movement.

10 Claims, 6 Drawing Sheets

(51) Int. Cl.
*F01L 1/18* (2006.01)
*F01L 1/047* (2006.01)

(52) U.S. Cl.
CPC ..... *F01L 2001/0476* (2013.01); *F01L 2001/0537* (2013.01); *F01L 2001/186* (2013.01); *F01L 2013/101* (2013.01); *F01L 2800/06* (2013.01)

(58) Field of Classification Search
CPC ..... F01L 2001/0476; F01L 2001/0537; F01L 2001/186; F01L 2001/187; F01L 2013/101; F01L 2800/06
USPC ..... 123/90.15, 90.16, 90.17, 90.18
See application file for complete search history.

(56) References Cited

FOREIGN PATENT DOCUMENTS

| | | | | |
|---|---|---|---|---|
| DE | 102004058997 | | 7/2006 | |
| DE | 102006023772 | | 11/2007 | |
| DE | 102006057894 | | 6/2008 | |
| DE | 102016220859 | | 9/2017 | |
| DE | 102017101792 | | 8/2018 | |
| DE | 102017101792 | a1 * | 8/2018 | ..... F01L 1/185 |
| JP | 2004108252 | | 4/2004 | |
| WO | 2015139692 | | 9/2015 | |
| WO | WO-2015139692 | A1 * | 9/2015 | ..... F01L 13/0036 |
| WO | 2017060496 | | 4/2017 | |
| WO | WO-2017060496 | A1 * | 4/2017 | ..... F01L 1/053 |

* cited by examiner

VARIABLE VALVE TRAIN OF AN INTERNAL COMBUSTION ENGINE

INCORPORATION BY REFERENCE

The following documents are incorporated herein by reference as if fully set forth: German Patent Application No. 10 2017 129 419.8, filed Dec. 11, 2017.

BACKGROUND

The invention relates to a variable valve train of an internal combustion engine with at least two functionally identical gas-exchange valves for each cylinder, whose valve strokes can be generated by at least one primary cam and one secondary cam of a camshaft and can be transferred by a switchable cam follower selectively to the allocated gas-exchange valves, wherein each cam follower has a primary lever in tapping contact with the associated primary cam and in switching contact with the associated gas-exchange valve and also a secondary lever in tapping contact with the associated secondary cam and can be coupled with the primary cam by an axial displacement of a control pin guided in a transverse hole. Each control pin of the cam follower is connected by connecting elements formed as leaf springs to an elongated switching element that is arranged above the cam follower parallel to the camshaft and can be moved longitudinally by a linear actuator against the restoring force of a spring element from a home position into a switched position.

Switchable valve trains of internal combustion engines are known in different constructions. For example, valve trains of individual cylinders or groups of cylinders of an internal combustion engine can be deactivated by switching off the transmittable valve stroke and in this way, in connection with switching off the fuel injection for the affected cylinders, the fuel consumption and $CO_2$ emissions and other harmful emissions of the internal combustion engine in partial load operation can be reduced. On the other hand, the stroke profiles that can be transferred by valve trains of intake and/or exhaust valves of an internal combustion engine can be changed by switching the strokes and in this way can be adapted to the current operating state of the internal combustion engine as a function of operating parameters, such as the engine speed and engine load, whereby the engine output and torque are increased and the specific fuel consumption of the internal combustion engine can be reduced.

In valve trains that can be switched off, typically two components that can move or rotate relative to each other are provided in a switchable stroke transmission element, of which one component is in switching connection with the associated cams of a camshaft and the other component is in switching connection with the valve shaft of the associated gas-exchange valve. Both components can be coupled with each other or decoupled from each other by a coupling element usually constructed as a coupling pin. In the coupled state, the valve stroke of the associated cam is transmitted to the affected gas-exchange valve, but is not transmitted in the decoupled state, so that the gas-exchange valve then remains closed. The coupling pin is typically guided so that it can move axially in a hole of one component and can move into a coupling hole of the other component. By the use of a spring element, the coupling pin is held in a home position and displaced and held there by the loading with a switching force against the restoring force of the spring element in an actuation position. In valve trains that can be deactivated, the home position of the coupling pin usually corresponds to the coupled state of the components of the stroke transmission element and the actuation position usually corresponds to the decoupled state of the components. The stroke transmission elements that can be deactivated can be cup tappets, roller tappets, cam followers, rocker arms, or support elements that can be deactivated.

In valve trains that can be switched, at least two components that can move or rotate relative to each other are provided in a switchable stroke transmission element, of which one component is in switching contact with an associated primary cam of a camshaft with a certain valve stroke and with the valve shaft of the associated gas-exchange valve and the other component is in switching contact with an associated secondary cam of the camshaft with a larger valve stroke or with an additional stroke. Both components can be coupled with each other or decoupled from each other by a coupling element usually constructed as a coupling pin. In the decoupled state, the valve stroke of the primary cam is transmitted to the affected gas-exchange valve, but in the coupled state, the larger valve stroke of the primary or secondary cam is transmitted to the gas-exchange valve. Here, the coupling pin can also typically move in a hole of one component and into a coupling hole of the other component. By the use of a spring element, the coupling pin is held in a home position and pushed into an actuation position and held there by the loading with a switching force against the restoring force of the spring element. In valve trains that can be switched, the home position of the coupling pin usually corresponds to the decoupled state of the components of the stroke transmission element and the actuation position usually corresponds to the coupled state of the components. Stroke transmission elements that can be switched are usually cup tappets, cam followers, or rocker arms that can be switched.

The adjustment of coupling elements of switchable stroke transmission elements is typically performed hydraulically in that a switching pressure line leading to pressure chambers of the coupling elements is connected or switched without pressure, for example, by means of a magnetic switching valve, selectively to an oil pressure source. A known construction of a switchable cam follower that is provided with a hydraulically adjustable coupling pin and is provided in an internal combustion engine for switching off the stroke of a gas-exchange valve is described in DE 10 2006 057 894 A1. In contrast, DE 10 2006 023 772 A1 describes a known construction of a switchable cam follower with a hydraulically adjustable coupling pin that is provided in an internal combustion engine for switching the stroke of a gas-exchange valve. The feeding of the switching pressure oil from the respective switching pressure line into a switchable cam follower is usually realized by a two-channel hydraulic support element, as is known, for example, from DE 103 30 510 A1.

If gas-exchange valves of an internal combustion engine can be switched off or switched selectively in groups, then for a hydraulic adjustment of the coupling elements, separate switching pressure lines are required each with an associated switching valve. A corresponding hydraulic control device for the selective group-wise adjustment of the coupling elements of a variable valve train in an internal combustion engine with two intake valves and two exhaust valves per cylinder is described, for example, in DE 102 12 327 A1. The switchable stroke transmission elements of the valve train are formed, in this case, as switchable cup tappets.

The coupling elements of switchable stroke transmission elements, however, can also be adjusted electromagnetically, in that the coupling elements are each in active connection with an electromagnet and the electromagnets are selectively energized or switched to a de-energized state. A known construction of a switchable cam follower that is provided with an electromagnetically adjustable coupling pin in an internal combustion engine for deactivating the stroke of a gas-exchange valve is disclosed in U.S. Pat. No. 5,544,626 B1. The coupling pin and the electromagnet, whose armature is connected to the coupling pin, are arranged longitudinally oriented in a primary lever of the cam follower, wherein a greater structural length of the cam follower and a correspondingly larger width of the affected cylinder head are produced.

In contrast, in DE 10 2016 220 859 A1, a valve train of an internal combustion engine with electromagnetically switchable cam followers is described, which is provided in an internal combustion engine for switching the stroke of the affected gas-exchange valves. The coupling pins are each arranged oriented longitudinally in the respective primary lever of the cam follower and can be brought into contact with a ramp surface of an armature rod of an associated electromagnet and can also be moved axially into a coupling position. The electromagnets are arranged with essentially vertical orientation above the cam follower and the associated camshaft on a carrier plate mounted on the affected cylinder head, wherein a larger structural height of the cylinder head is produced.

Because the arrangement of separate hydraulic switching pressure lines or electrical switching lines in a cylinder head of an internal combustion engine is relatively difficult and expensive due to the tight space requirements, in the not previously published DE 10 2017 101 792 A1, a variable valve train of an internal combustion engine was proposed in which the valve stroke of multiple functionally identical gas-exchange valves can be deactivated or switched by a single actuator.

The switchable cam followers of this valve train each have a primary lever and a secondary lever. The primary lever is supported with its one end on an associated support element supported on the housing side and with its other end on the valve shaft of the associated gas-exchange valve and is in tapping contact with the associated primary cams between its ends. The secondary lever is supported so that it can swivel on the primary lever, is in tapping contact with the associated secondary cams, and can be coupled with the primary lever by a movable coupling element. The coupling elements of the switchable cam followers are each constructed as a coupling pin that is guided so that it can move axially in a transverse hole of the primary lever and can be moved by a control pin supported so that it can move axially in a transverse hole of the secondary lever against the restoring force of a spring element into an opposing coupling hole of the secondary lever. Each control pin projects with its outer end from the secondary lever and is in switching connection with a control rod constructed as a flat rod on this lever by means of a rod-shaped connecting element directed upward. The control rod is arranged above the cam follower parallel to the allocated camshaft and can be moved longitudinally from a home position into a switched position by means of a linear actuator against the restoring force of a spring element.

Another valve train according to the class is known from JP 2004 108 252 A, in which an elongated switching elements can likewise be moved by a linear actuator against the restoring force of a spring laterally from a home position into a switched position. Control pins that couple or release valve switching elements with each other are also arranged there in transverse holes of the same.

In addition, from DE 10 2004 058 997 A1, a valve train is known, in which according to one embodiment, an elongated switching element that can be moved laterally by an electric actuator can be used for switching the valve stroke.

Moreover, from WO 2015/139 692 A1, an electromagnetic double actuator is known, by which two adjacent control elements can be displaced laterally.

Finally, from WO 2017/060 496 A1, a valve train of an internal combustion engine is known, in which a shaft that can be driven by an electric motor carries leaf spring-like control elements, with which control pins arranged on switching cam followers can be actuated by these cam followers in the longitudinal direction. By the use of these control pins, the inner lever and the outer lever of the respective switching cam followers can be coupled with each other or released from each other.

SUMMARY

Based on this background, the present invention concerns the objective of providing a variable valve train of an internal combustion engine of the type noted above, in which the valve stroke of functionally identical first gas-exchange valves and functionally identical second gas-exchange valves of at least a few cylinders can be deactivated or switched independent from each other in groups with a space-saving and economical construction.

This objective is achieved by a valve train with one or more features of the invention. Advantageous constructions and refinements of the valve train according to the invention are described below and in the claims.

Accordingly, a variable valve train of an internal combustion engine with at least two functionally identical gas-exchange valves per cylinder is provided, whose valve stroke can be generated by at least one primary cam and one secondary cam of a camshaft and can be transmitted by a switchable cam follower selectively to the associated gas-exchange valves, wherein the respective cam follower has a primary lever in tapping contact with the associated primary cam and in switching contact with the associated gas-exchange valve and a secondary lever in tapping contact with the associated secondary cam and can be coupled with the primary lever by an axial displacement of a control pin guided in a transverse hole, wherein the respective control pins of the cam follower are connected by connecting elements constructed as leaf springs to an elongated switching element that is arranged above the cam follower parallel to the camshaft and can be shifted longitudinally by a linear actuator against the restoring force of a spring element from a home position into a switched position, wherein the control pins of the cam follower of the functionally identical first gas-exchange valves are in switching connection by the associated connecting elements with a first elongated switching element that can be moved longitudinally by a first linear actuator, wherein the control pins of the cam followers of functionally identical second gas-exchange valves are in switching connection by the associated connecting elements with a second elongated switching element that can be moved longitudinally by a second linear actuator, wherein the two elongated switching elements are arranged parallel one above the other with a small vertical distance and are guided so that they can move axially in multiple vertically adjacent, housing-fixed guide openings of a cylinder head, wherein the two elongated switching elements are each provided with passage openings with appropriately sized dimensions for the contactless passage of the connecting elements of the other elongated switching element, wherein the linear actuators are arranged radially adjacent in a housing of a common actuator module and are in switching connection by a tappet that is supported so that it can move axially in the housing with the associated elongated switching element and in which the linear actuators are formed as electromagnets each with an armature guided so that it can move axially in a coil body.

Due to the switching connection of the control pins of the cam followers of functionally identical first and second gas-exchange valves with separate elongated switching elements that can be moved longitudinally by separate linear actuators that are, however, arranged adjacent in a housing of a shared actuator module, in a simple way the ability is created to deactivate or switch the first valve stroke of the first gas-exchange valves and the second gas-exchange valves independent from each other.

Here, it is an especially space-saving arrangement that the two elongated switching elements are arranged in parallel one above the other with a slight vertical distance and are guided so that they can move axially in multiple vertically adjacent housing-fixed guide openings of a cylinder head. Because this arrangement of the control rods maintains the geometry of the switching connections between the control pins and the control rods above the leaf springs, the switchable cam followers of the first gas-exchange valves and the second gas-exchange valves can also have a structurally identical design.

For enabling the vertically stacked arrangement of the two elongated switching elements, these are each provided with passage openings with appropriately sized dimensions for the contactless passage of the connecting elements of the other control rods.

At least a few guide openings of the elongated switching elements are arranged preferably in bearing caps of the associated camshaft, so that no additional components are needed for guiding the elongated switching elements and no additional installation space is claimed.

To keep the installation space requirements of the two linear actuators to a minimum and to simplify their assembly and energy supply, the two linear actuators are advantageously arranged radially adjacent in a housing of a common actuator module and they are in switching connection by a tappet that is supported so that it can move axially in the housing with the associated elongated switching element.

The two linear actuators are preferably constructed as electromagnets each with an armature guided so that it can move axially in a coil body and are in switching connection by a transmission lever that is supported so that it can swivel in the housing with the relevant tappet. By this construction and arrangement of the transmission lever, the switching path of the tappet relative to the switching path of the armature and also the radial distance of the tappet relative to the radial distance of the armature can be changed in a suitable way.

In order to increase the switching path of the tappet in comparison to the switching path of the armature and in order to reduce the radial distance of the tappet relative to the radial distance of the armature, preferably such an arrangement of the transmission lever is provided in which the transmission levers are supported so that they can swivel radially outward with respect to a plane of symmetry between the electromagnets and radially inward with the associated tappet and are also in switching contact in-between with the armature of the associated electromagnet.

The elongated switching elements can be constructed, for example, as switching rods, flat bars, or as elongated switching plates.

BRIEF DESCRIPTION OF THE DRAWINGS

For further illustration of the invention, drawings with an embodiment are provided. Shown in this drawing are.

DETAILED DESCRIPTION

Figure 1:
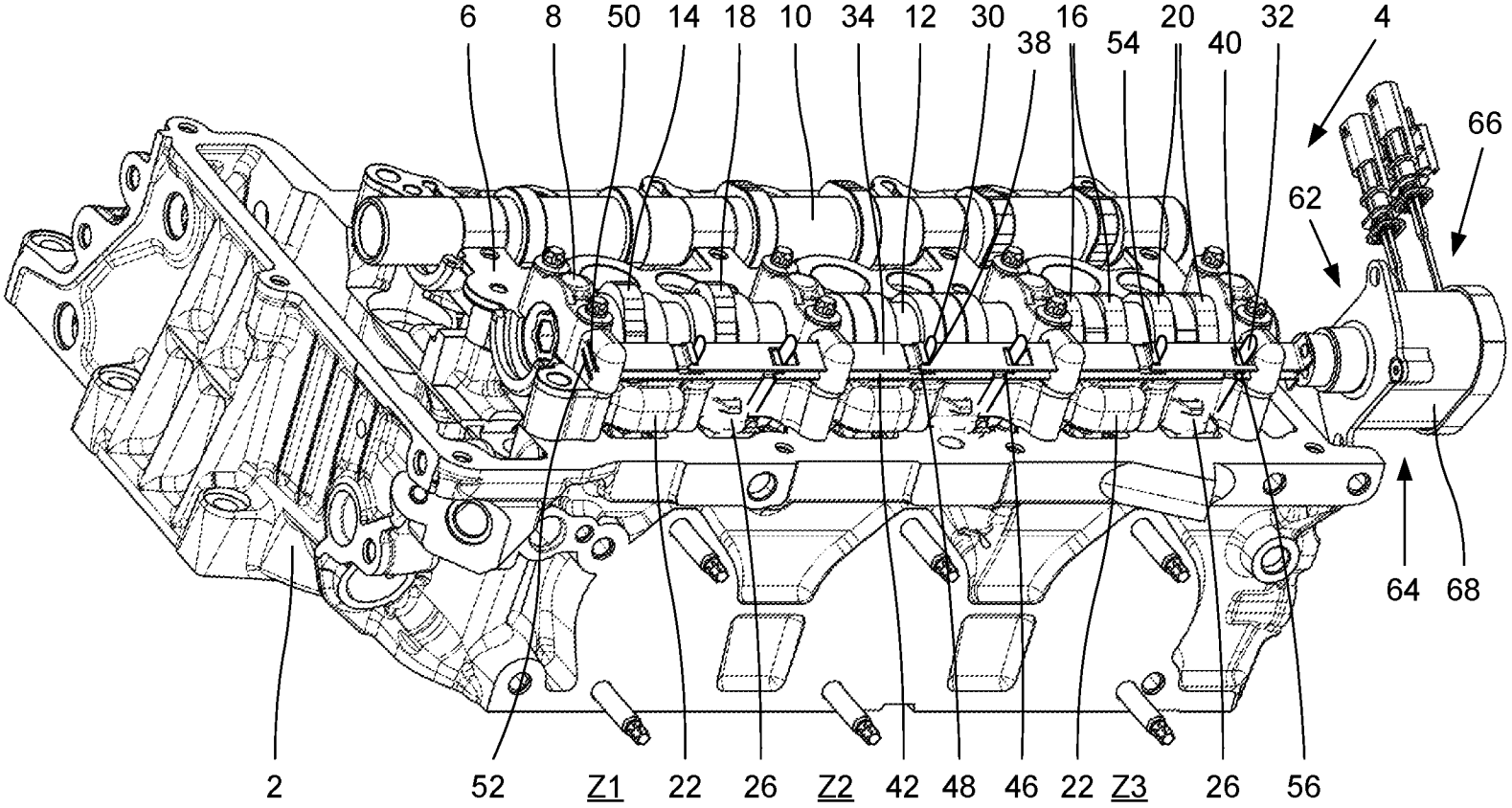
FIG. 1 a preferred embodiment of a variable valve train according to the invention in a combustion piston engine with three cylinders and two functionally identical gas-exchange valves for each cylinder with six switchable cam followers in a perspective overview, FIG. 2 the valve train according to FIG. 1 in the non-switched state of all switchable cam followers in a side view, FIG. 2A an enlarged detail A of the valve train according to FIG. 2, FIG. 3 the valve train according to FIG. 1 in the switched state of the switchable cam followers of functionally identical first gas-exchange valves and in the non-switched state of the switchable cam followers of functionally identical second gas-exchange valves in a side view, FIG. 3A an enlarged detail A of the valve train according to FIG. 3, FIG. 4 the valve train according to FIG. 1 in the non-switched state of the switchable cam followers of the functionally identical first gas-exchange valves and in the switched state of the switchable cam followers of the functionally identical second gas-exchange valves in a side view, FIG. 4A an enlarged detail A of the valve train according to FIG. 4, FIG. 5 the valve train according to FIG. 1 in the switched state of all switchable cam followers in a side view, FIG. 5A an enlarged detail A of the valve train according to FIG. 5, FIG. 6 an actuator module for switching the switchable cam followers in a perspective view, and FIG. 6A the actuator module according to FIG. 6 in a longitudinal middle section.

In the perspective overview illustration of FIG. 1, a cylinder head 2 of an internal combustion engine is shown with three cylinders Z1, Z2, Z3 arranged in line and also one intake valve and two exhaust valves per cylinder together with components of a valve train 4 according to the invention. A camshaft carrier 6 screwed with the cylinder head 2 has four semicircular sliding bearing sections for supporting an intake camshaft 10 and also four semicircular sliding bearing sections for supporting an exhaust camshaft 12. The remaining sliding bearing sections for supporting the intake camshaft 10 and the exhaust camshaft 12 are part of bearing caps 8 that are placed and screwed on the camshaft carrier 6 after the camshafts 10, 12 are inserted. In FIG. 1, only the bearing caps 8 of the exhaust camshaft 12 are shown.

The valve stroke of the first exhaust valves of all three cylinders that cannot be seen in the illustration of FIG. 1 can be switched by allocated first switchable cam followers 22. Likewise, the valve stroke of the second exhaust valves of all three cylinders that cannot be seen in FIG. 1 can be switched by allocated second switchable cam followers 26. For this purpose, the exhaust camshaft 12 for the first exhaust valves and also for the second exhaust valves has a centrally arranged primary cam 14, 18 and two secondary cams 16, 20 arranged on both sides of the respective primary cam 14, 18.

The first and second switchable cam followers 22, 26 have essentially identical constructions here and each have a primary lever and a secondary lever. In the not-switched state of the cam followers 22, 26 in which the respective secondary lever is decoupled from the affected primary lever, the stroke profile of the primary cams 14, 18 is transmitted to the associated exhaust valves. In the switched state of the cam followers 22, 26 in which the respective secondary lever is coupled with a positive fit with the affected primary lever, the larger stroke of the primary cams 14, 18 or of the secondary cams 16, 20 is transmitted to the associated exhaust valves. The switching of the cam followers 22, 26 into the coupled state is realized by an axial displacement of a control pin 24, 28 that cannot be seen in FIG. 1 and is supported so that it can move axially in a transverse hole of the respective secondary lever and projects with its axially outer end from the secondary lever and is in switching connection with this by an upward oriented, rod-shaped connecting element 30, 32 each with elongated switching elements 34, 42 constructed as a flat rod. The actual construction and the function of the switchable cam followers 22, 26 corresponds to that of the cam followers described in detail in DE 10 2017 101 792 A1, so that the contents of this publication should also be considered as incorporated herein by reference as if fully set forth. Therefore, further description will be omitted here.

Figure 2:
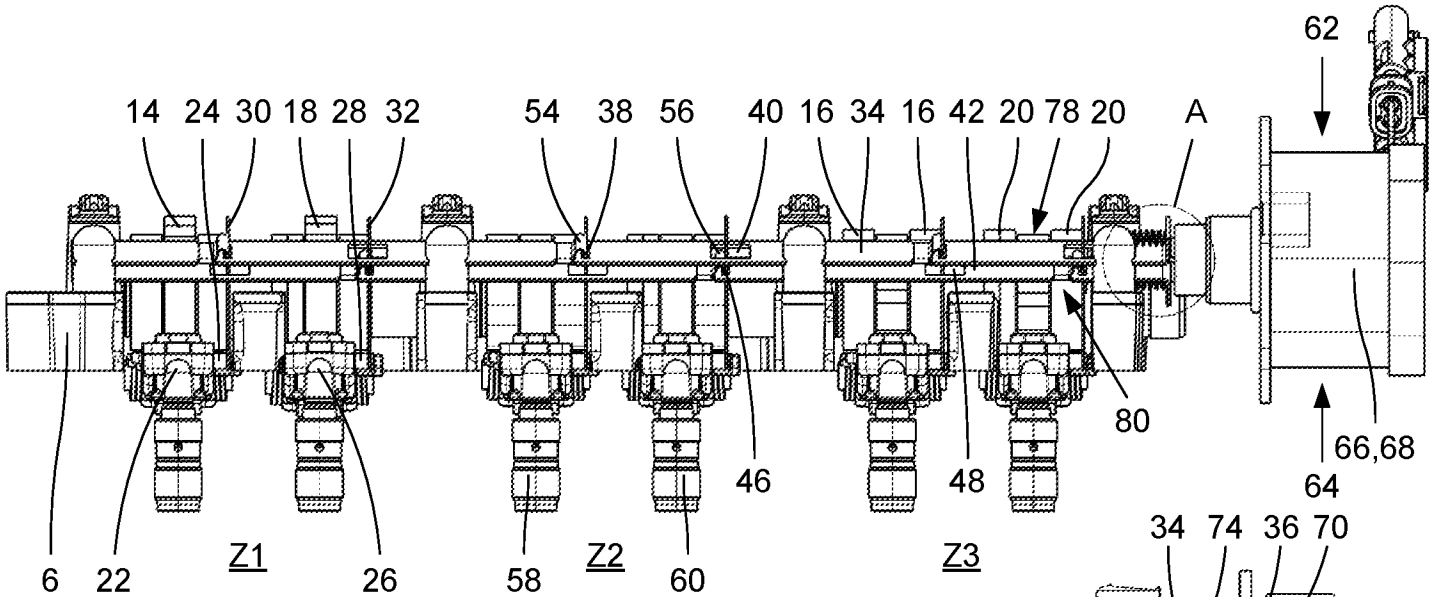

The control pins 24 of cam followers 22 of the first exhaust valves are in switching connection by the associated connecting elements 30 that are constructed as leaf springs and are connected in an articulated way with the respective control pins 24 with a first elongated switching means 34 that can be moved longitudinally by means of a first linear actuator 62 (FIG. 2). The control pins 28 of cam followers 26 of the second exhaust valves are in switching connection by the connecting elements 32 also constructed as leaf springs and connected in an articulated way with the respective control pin 28 with a second elongated switching element 42 that can be moved longitudinally by a second linear actuator 64.

The two linear actuators 62, 64 are arranged in a housing 68 of a common actuator module 66 that is screwed with the cylinder head 2.

The leaf springs 30, 32 are each mounted on the relevant control pins 24, 28 according to a type of retaining plate by the placement and engagement with its hole that is open at the end in an annular groove arranged on the outer end of the respective control pin 24, 28. Possible constructions of such an articulated connection are indicated, for example, in the not previously published DE 10 2017 119 653 A1.

The elongated switching elements 34, 42 are arranged above the switchable cam followers 22, 26 parallel to the exhaust camshaft 12 at a small vertical distance in parallel one above the other and guided so that they can move axially in multiple adjacent housing-fixed guide openings 50, 52. In the present case, the first elongated switching element 34 is arranged above the second elongated switching element 42.

The housing-fixed guide openings 50, 52 for the two control rods 34, 42 are arranged in the bearing caps 8 of the camshaft carrier 6 for the exhaust camshaft 12.

The connecting elements 30, 32 constructed as leaf springs in the switchable cam followers 22, 26 each engage with play in a slot-shaped driver opening 38, 46 of the associated elongated switching elements 34, 42. In this way, the leaf springs 30, 32 can move with low wear in the driver openings 38, 46 of the elongated switching elements 34, 42 during the operation of the internal combustion engine. In addition, in this way, production tolerances in the arrangement and size of the driver openings 38, 46 and the elongated switching elements 34, 42 themselves can be equalized in a simple way by an enlarged switching path of the linear actuators 62, 64.

On their wider outer wall facing away from the cam followers 22, 26, the elongated switching elements 34, 42 are provided on each driver opening 38, 46 on the switching direction side with an arc-shaped spring clip 54, 56, whose free end for the elastic support of the associated leaf springs 30, 32 projects in the longitudinal direction into the affected driver opening 38, 46. In this way, the leaf springs 30, 32 are supported elastically and movable longitudinally in the driver openings 38, 46 of the elongated switching elements 34, 42, wherein the mechanical wear to the contact surfaces and the transmission of transverse forces to the control pins 24, 28 of the cam followers 22, 26 is reduced. For the contactless passage of the leaf springs 30, 32 of the other elongated switching elements 34, 42, the elongated switching elements 34, 42 are each provided with passage openings 40, 48 with appropriately sized dimensions.

In FIG. 2, the camshaft carrier 6 is shown together with the switchable cam followers 22, 26, the leaf springs 30, 32, the elongated switching elements 34, 42, and the actuator module 66 in a side view. In addition, in FIG. 2, hydraulic support elements 58, 60 are also shown, by which the cam followers 22, 26 are supported in the installed state on one end on the cylinder head 2.

Figure 2A:
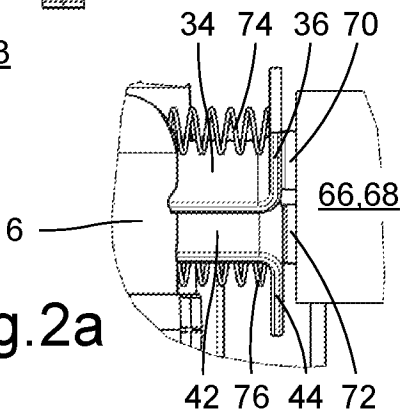

In the detail A from FIG. 2 shown enlarged in FIG. 2A, it can be seen that the two linear actuators 62, 64 are each in switching connection with an angled end 36, 44 of the associated elongated switching elements 34, 42 by a tappet 70, 72 that can move axially. The two elongated switching elements 34, 42 are each held in the home position 78, 80 shown in FIGS. 2 and 2A by a spring element 74, 76 that is constructed as a helical spring and is arranged between the angled end 36, 42 of the relevant elongated switching element 34, 42 and the adjacent end wall of the camshaft carrier 6. The elongated switching elements 34, 42 can be moved by the linear actuators 62, 64 each independently from each other against the restoring force of the respective helical spring 74, 76 by a longitudinal displacement in a switching direction 82 into the switched position 84, 86 shown in the following figures.

Figures 3, 3A:
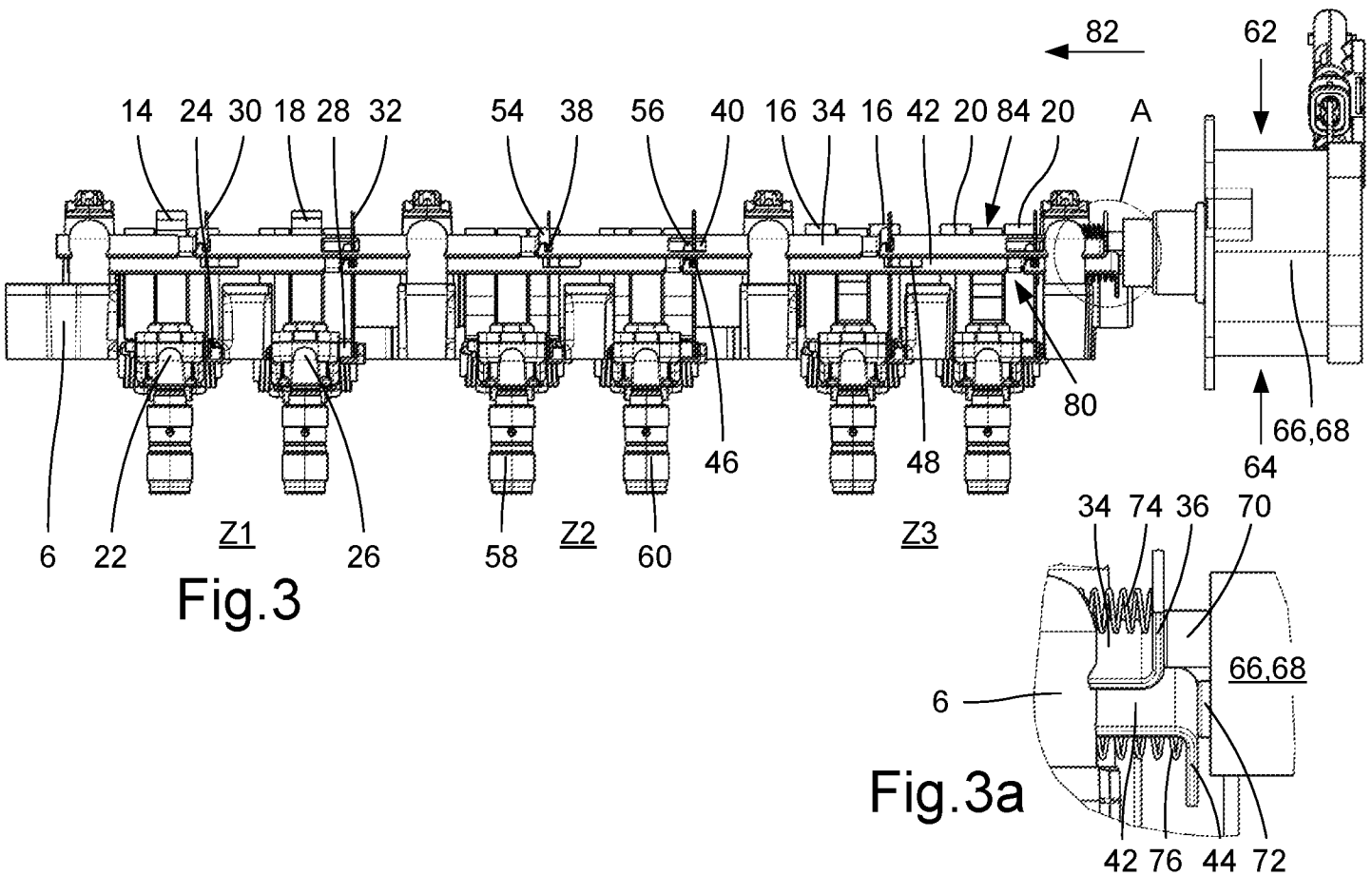

In the side view of FIG. 3 and the section A from FIG. 3 shown enlarged in FIG. 3A, the first elongated switching element 34 is shifted by an actuation of the first linear actuator 62 against the restoring force of the affected helical spring 74 by the associated tappet 70 in the switching direction 82 into its switched position 84, in which the switchable cam followers 22 of the first exhaust valve are switched or will be switched by the associated leaf springs 30 through an axial displacement of their control pins 24 inward into the coupled switch state.

For those cam followers 22 in which the primary and secondary cams 14, 16 of the exhaust camshaft 12 are tapped by the primary and secondary levers just in the reference circle, the switching happens immediately. For those cam followers 22 in which the primary and secondary cams 14, 16 of the exhaust camshaft 12 are barely not tapped in the reference circle by the primary and secondary levers, the affected control pins 24 are initially only pretensioned in the axial direction. The actual switching takes place when the exhaust camshaft 12 continues to rotate, that is, when the primary and secondary cams 14, 16 are tapped by their primary and secondary levers simultaneously in the reference circle.

The second control rod 42 is in its home position 80 in the operating situation shown in FIGS. 3 and 3A, so that the switchable cam followers 26 of the second exhaust valves are in their not-switched state in which the relevant secondary levers are decoupled from the primary levers.

Figures 4, 4A:
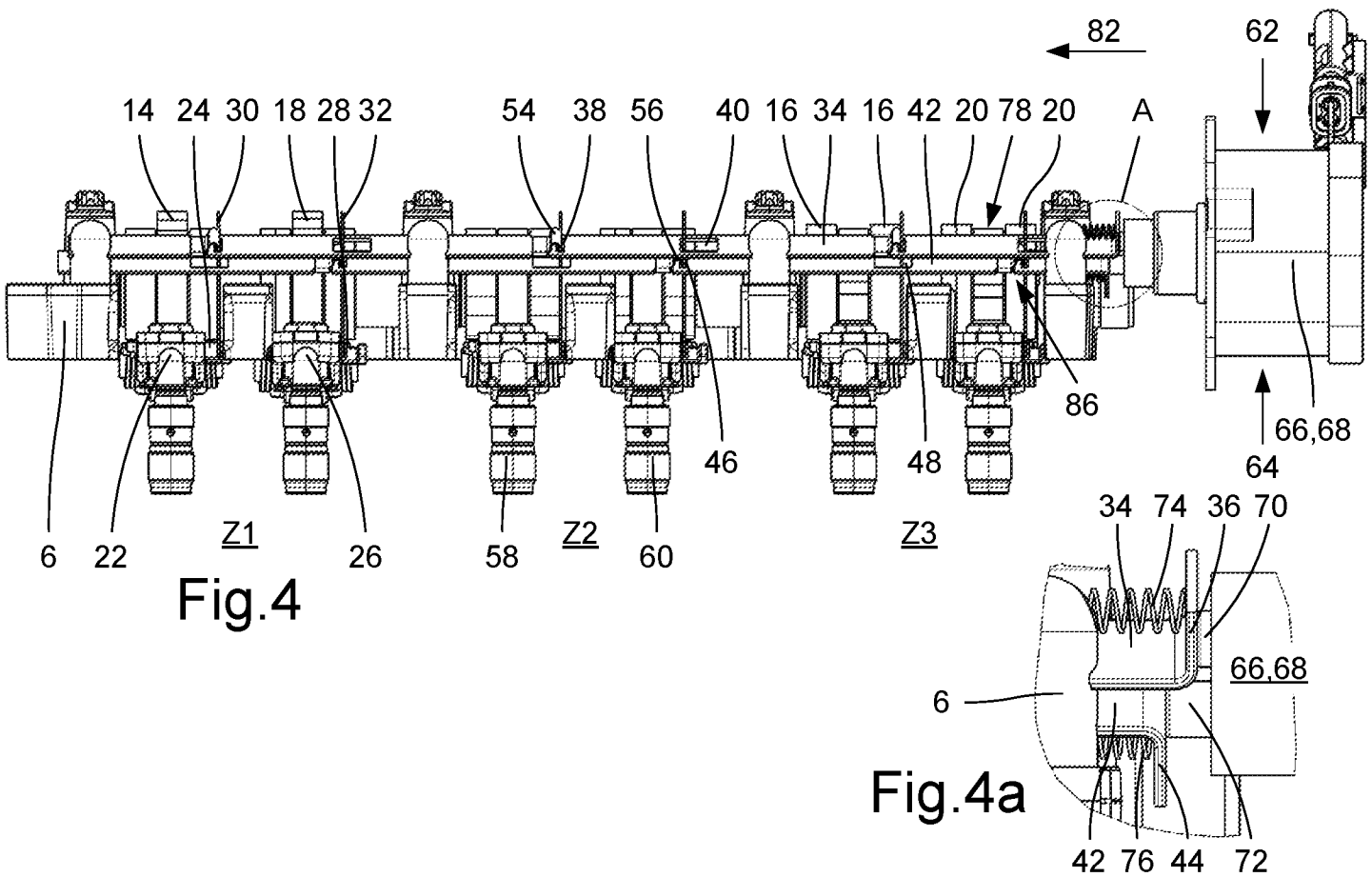

In the side view of FIG. 4 and the section A from FIG. 4 shown enlarged in FIG. 4A, the second control rod 42 is shifted into its switched position 86 by an actuation of the second linear actuator 64 against the restoring force of the associated helical spring 76 by the associated tappet 72 in the switching direction 82, in which the switchable cam followers 26 of the second exhaust valves are switched or will be switched inward into the coupled switch state by the associated leaf springs 32 by an axial displacement of their control pins 28.

In those cam followers 26 in which the primary and secondary cams 18, 20 of the exhaust camshaft 12 are just tapped in the reference circle by the primary and secondary levers, the switching happens immediately. In those cam followers 26 in which the primary and secondary cams 18, 20 of the exhaust camshaft 12 are barely not tapped in the reference circle by the primary and secondary levers, the affected control pins 28 are initially pretensioned only axially and the actual switching takes place when the exhaust camshaft 12 continues to rotate, as soon as the primary and secondary cams 18, 20 are tapped by their primary and secondary levers simultaneously in the reference circle.

The first elongated switching element 34 is in its homes position 78, so that the switchable cam followers 22 of the first exhaust valves are in their not-switched state, in which the relevant secondary levers are decoupled from the primary levers.

Figure 5:
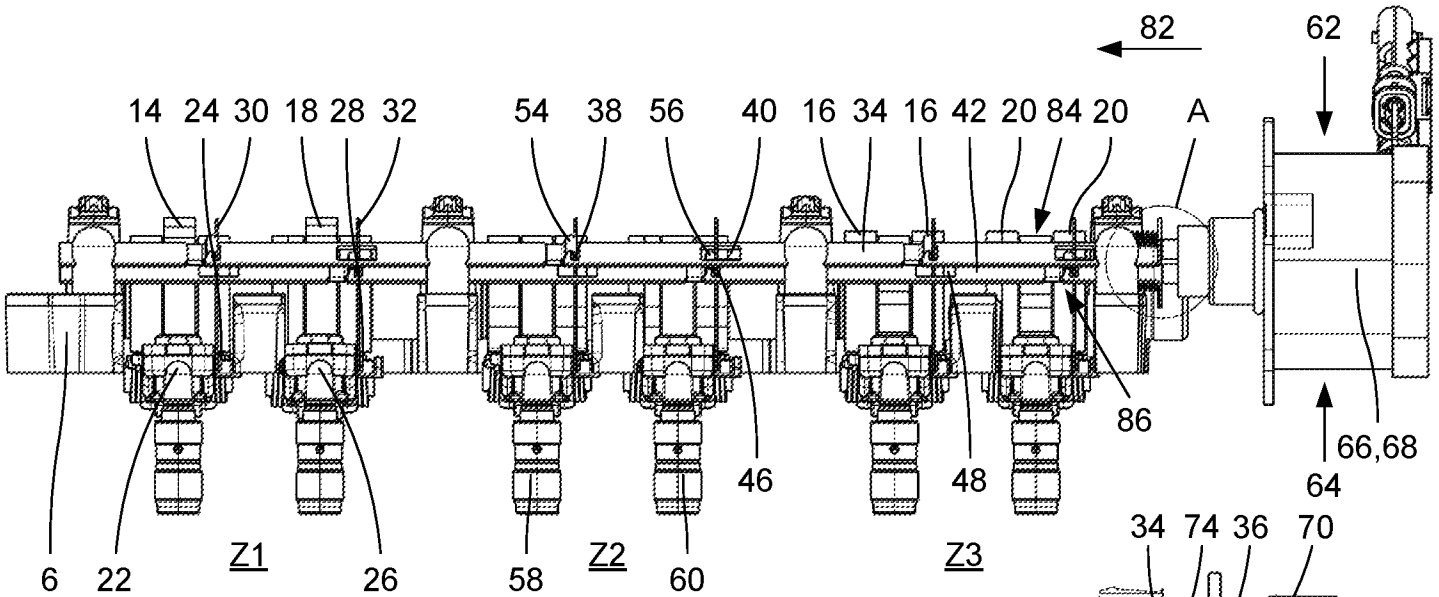
Figure 5A:
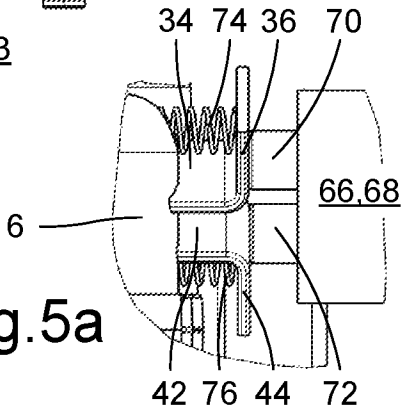

In the side view of FIG. 5 and the section A from FIG. 5 shown enlarged in FIG. 5A, both the first elongated switching element 34 is shifted by an actuation of the first linear actuator 62 and also the second elongated switching element 42 is shifted by an actuation of the second linear actuator 64 against the restoring force of the associated helical springs 74, 76 by the associated tappets 70, 72 in the switching direction 82 into their switched positions 84, 86. In these switched positions 84, 86, the switchable cam followers 22 of the first exhaust valves and the switchable cam followers 26 of the second exhaust valves are switched or will be switched inward into the coupled switch state by the respective leaf springs 30, 32 by an axial displacement of their control pins 24, 28.

When the linear actuators 62, 64 are switched off, the control rods 34, 42 are restored opposite the switching direction 82 into their home position 78, 80 by the restoring force of the respective helical springs 74, 76. The decoupling of the switchable cam followers 22, 26 is realized by an axial displacement of the affected control pins 24, 28 outward, which is realized by the restoring force of an internal spring element and is possible with the simultaneous tapping of the primary and secondary cams 14, 16; 18, 20 of the exhaust camshaft 12 by the primary and secondary levers, that is, for control pins 24, 28 free of transverse force.

Figure 6:
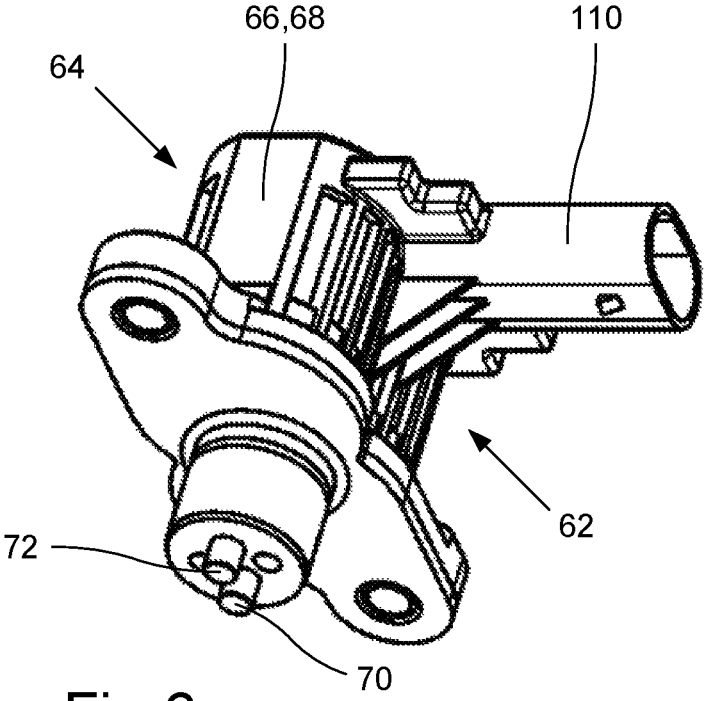
Figure 6A:
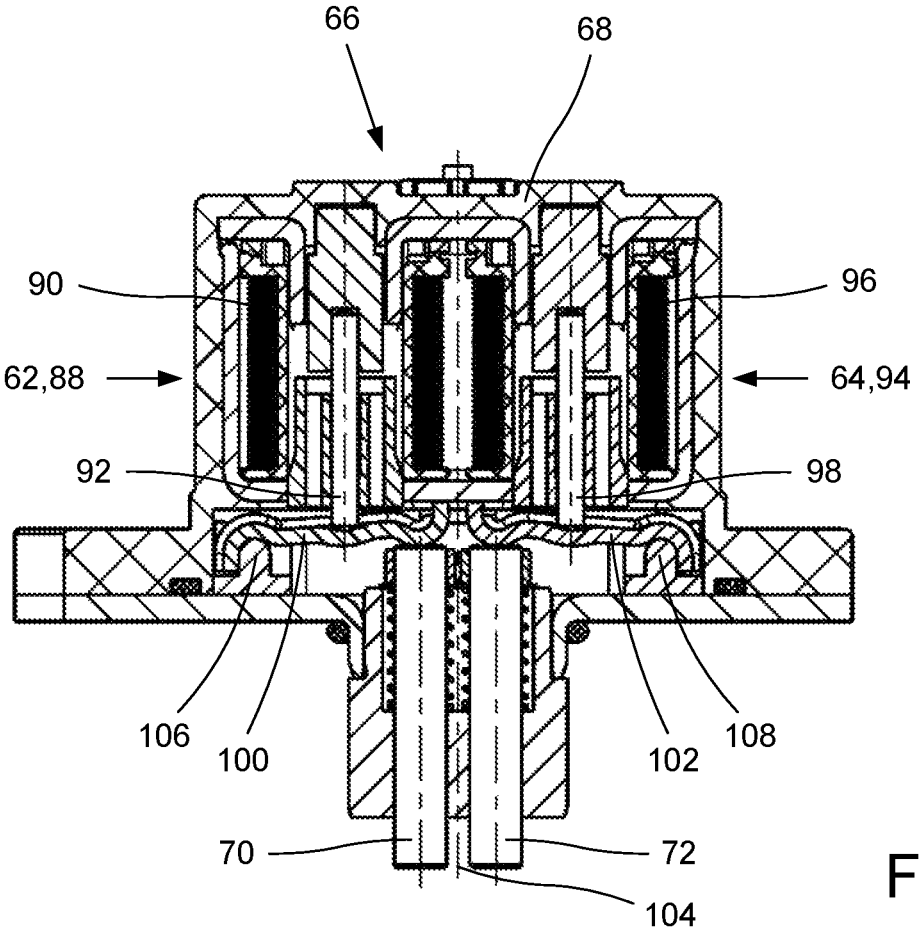

In the perspective view of FIG. 6 and the longitudinal middle section of FIG. 6A, a preferred construction of an actuator module 66 is shown with the two already mentioned linear actuators 62, 64. The two linear actuators 62, 64 are arranged radially adjacent a housing 68 of the actuator module 66 and each are in switching connection with an axially movable tappet 70, 72 supported in the housing 68. In the installed state, the tappets 70, 72 each contact the angled end 36, 44 of the associated elongated switching elements 34, 42 on the outside.

As the section view according to FIG. 6A shows, in particular, the two linear actuators 62, 64 are constructed as electromagnets 88, 94 each with an armature 92, 98 guided axially movable in a coil body 90, 96. The armatures 92, 98 of the electromagnets 88, 94 are each in switching connection with the associated tappet 70, 72 by a transmission lever 100, 102 that is supported so that it can swivel.

The two transmission levers 100, 102 are supported so that they can swivel with respect to a plane of symmetry 104 between the electromagnets 99, 94 on the radial outer side on a bearing rib 106, 108 inserted into the housing 68 and are in switching contact radially on the inner side with the associated tappet 70, 72 and in-between with the armatures 92, 98 of the associated electromagnets 88, 94. Through this arrangement of the transmission levers 100, 102, the switching path of the tappets 70, 72 is increased relative to the switching path of the armature 92, 98 and the radial distance of the tappets 70, 72 is significantly reduced relative to the radial distance of the armature 92, 98 of the electromagnets 88, 94. For powering the electromagnets 88, 94, the housing 68 of the actuator module 66 is provided with a molded connector bushing 110.

LIST OF REFERENCE SYMBOLS

2 Cylinder head
4 Valve train
6 Camshaft carrier
8 Bearing cap
10 Intake camshaft
12 Exhaust camshaft
14 Primary cam
16 Secondary cam
18 Primary cam
20 Secondary cam
22 Switchable cam follower
24 Control pin
26 Switchable cam follower
28 Control pin
30 Connecting element, leaf spring
32 Connecting element, leaf spring
34 Elongated switching means, first control rod
36 Angled end
38 Driver opening
40 Passage opening
42 Elongated switching means, second control rod
44 Angled end
46 Driver opening
48 Passage opening
50 Guide opening
52 Guide opening
54 Spring clip
56 Spring clip
58 Hydraulic support element
60 Hydraulic support element
62 First linear actuator
64 Second linear actuator
66 Actuator module
68 Housing
70 First tappet
72 Second tappet
74 Spring element, helical spring
76 Spring element, helical spring

78 Home position of the switching means 34
80 Home position of the switching means 42
82 Switching direction
84 Switched position of the switching means 34
86 Switched position of the switching means 42
88 First electromagnet
90 First coil body
92 First armature
94 Second electromagnet
96 Second coil body
98 Second armature
100 First transmission lever
102 Second transmission lever
104 Plane of symmetry
106 First bearing rib
108 Second bearing rib
110 Connector bushing
A Drawing section
Z1 First cylinder
Z2 Second cylinder
Z3 Third cylinder

The invention claimed is:

1. A variable valve train of an internal combustion engine with at least two gas-exchange valves per cylinder, the variable valve train comprising:

a camshaft with primary cams and secondary cams that are adapted to generate valve strokes;

switchable cam followers that selectively transmit the valve strokes to associated ones of the gas-exchange valves;

the switchable cam followers have primary levers in tapping contact with an associated one of the primary cams and in switching contact with an associated one of the gas-exchange valves and secondary levers in tapping contact with an associated one of the secondary cams;

control pins that are configured to couple the secondary levers with the primary levers via axial displacement of the control pins, each said control pin being guided in a respective transverse hole;

connecting elements connected to the control pins of the switchable cam followers, the connecting elements are constructed as leaf springs;

first and second elongated switching elements arranged above the switchable cam followers, and the first and second elongated switching elements are parallel to the camshaft;

first and second linear actuators that respectively displace the associated first or second elongated switching elements longitudinally against a restoring force of respective first and second spring elements from a home position into a switched position;

the control pins of the switchable cam followers of first ones of the gas-exchange valves are in switching connection with the first elongated switching element by associated ones of the connecting elements, and are configured to move longitudinally by the first linear actuator;

the control pins of the switchable cam followers of second ones of the gas-exchange valves are in switching connection with the second elongated switching element by associated ones of the connecting elements, and are configured to move longitudinally by the second linear actuator;

the first and second elongated switching elements are arranged in parallel with a vertical spacing therebetween in a use position, one above the other, and are guided for axial movement in multiple vertically adjacent, housing-fixed guide openings of a cylinder head;

the first elongated switching elements is provided with at least one passage opening dimensioned to receive the connecting elements of the second elongated switching element, and the second elongated switching element is provided with at least one passage opening dimensioned to receive the connecting elements of the first elongated switching element;

a common actuator module having a housing in which the first and second linear actuators are arranged radially adjacent and are each in switching connection by a tappet that is held in the housing for axial movement with the first or second elongated switching element; and the first and second linear actuators are constructed as electromagnets each including an armature guided in a coil body for axial movement.

2. The variable valve train according to claim 1, further comprising bearing caps for the camshaft, the bearing caps include at least a few guide openings for the first and second elongated switching elements.

3. The variable valve train according to claim 1, wherein the armatures of the electromagnets are in switching connection with an associated one of the tappets via transmission levers supported for swiveling movement in the housing.

4. The variable valve train according to claim 3, wherein the transmission levers are each supported to swivel radially outward with respect to a plane of symmetry between the electromagnets and are each in switching contact with the tappets and the armatures of the electromagnets.

5. A variable valve train of an internal combustion engine with at least two gas-exchange valves per cylinder, the variable valve train comprising:

a camshaft with primary cams and secondary cams that are adapted to generate valve strokes;

switchable cam followers that selectively transmit the valve strokes to associated ones of the gas-exchange valves;

the switchable cam followers have primary levers in tapping contact with an associated one of the primary cams and in contact with an associated one of the gas-exchange valves and secondary levers in tapping contact with an associated one of the secondary cams;

control pins that are configured to couple the secondary levers with the primary levers via axial displacement of the control pins, each said control pin being guided in a respective transverse hole;

connecting elements connected to of the control pins of the switchable cam followers;

first and second elongated switching elements arranged parallel to the camshaft;

first and second linear actuators that respectively displace the first or second elongated switching elements longitudinally against a restoring force of respective first and second spring elements from a respective home position into a respective switched position;

the control pins of the switchable cam followers of first ones of the gas-exchange valves are connected to the first elongated switching element by associated ones of the connecting elements, and are configured to move longitudinally by the first linear actuator;

the control pins of the switchable cam followers of second ones of the gas-exchange valves are connected to the second elongated switching element by associated ones of the connecting elements, and are configured to move longitudinally by the second linear actuator;

the first and second elongated switching elements are arranged in parallel with a spacing therebetween in a use position, and are guided for axial movement in multiple adjacent, housing-fixed guide openings of a cylinder head;

the first elongated switching element is provided with at least one passage opening dimensioned to receive the connecting elements of the second elongated switching element;

a common actuator module having a housing in which the first and second linear actuators are arranged radially adjacent to one another and are each in contact with the associated one of the first or second elongated switching element; and the first and second linear actuators are constructed as electromagnets each including an armature guided in a coil body for axial movement.

6. The variable valve train according to claim 5, further comprising first and second tappets associated with the respective first and second elongated switching elements, the first and second tappets being driven by the armatures.

7. The variable valve train according to claim 6, wherein the armatures of the electromagnets are in switching connection with the tappets via transmission levers supported for swiveling movement in the housing.

8. The variable valve train according to claim 7, wherein the transmission levers are each supported to swivel radially outward with respect to a plane of symmetry between the electromagnets and are each in switching contact with the tappets and the armatures of the electromagnets.

9. The variable valve train according to claim 5, wherein each of the first and second elongated switching elements are guided in openings in camshaft bearing caps.

10. The variable valve train according to claim 5, wherein the second elongated switching element is provided with at least one passage opening dimensioned to receive the connecting elements of the first elongated switching element.

* * * * *